United States Patent [19]

Jongerius

[11] Patent Number: 4,694,715

[45] Date of Patent: Sep. 22, 1987

[54] SLICING DEVICE FOR BREAD OR THE LIKE

[75] Inventor: Sebastiaan C. E. Jongerius, Renswoude, Netherlands

[73] Assignee: Jongerius B.V., Soesterberg, Netherlands

[21] Appl. No.: 904,872

[22] Filed: Sep. 8, 1986

[30] Foreign Application Priority Data

Sep. 17, 1985 [NL] Netherlands ..... 8502547

[51] Int. Cl.[4] ..... B26D 1/48

[52] U.S. Cl. ..... 83/72; 83/807; 83/819; 83/435.2

[58] Field of Search ..... 83/72, 807, 819, 435.2

[56] References Cited

U.S. PATENT DOCUMENTS

| | | | |
|---|---|---|---|
| 579,382 | 3/1897 | Coleman | 83/819 |
| 616,219 | 12/1898 | Wilkin | 83/819 |
| 2,300,278 | 10/1942 | Hartman | 83/807 |
| 2,311,762 | 2/1943 | Kottmann et al. | 83/807 X |
| 2,328,911 | 9/1943 | Kottmann | 83/807 |
| 2,795,254 | 6/1957 | Hill | 83/807 |

*Primary Examiner*—Donald R. Schran

*Attorney, Agent, or Firm*—Louis Orenbuch; Lawrence Green

[57] ABSTRACT

Slicing device for breads, having a plurality of endless slicer bands which extend substantially parallel to each other and which are passed over drums. At least one of the drums is automatically adjustable and acts as a tensioning means for maintianing a substantially constant tension in the slicer bands. The adjustable drum is supported by cylinder-plunger assemblies one at each side of said drum. The cylinder-plunger assemblies are operable independently of each other. The supports of both drums are connected to each other by a bracket which is mounted to a stationary frame on one side of the respective drum. Both brackets extend in between both parts of the slicer bands.

16 Claims, 4 Drawing Figures

SLICING DEVICE FOR BREAD OR THE LIKE

The invention relates to a slicing device for breads or the like, comprising a plurality of endless slicer bands, which extend substantially parallel to each other and which are passed over drums, and tensioning means for biasing the slicer bands engage the slicer bands.

Such slicing devices for bread or the like are already known. In these slicing devices the problem arises, that during operation thereof the variation in temperature of the slicer bands is fairly great (in the order of 40° C.), whereby the length of the slicer bands and therefore also the tension thereof varies during operation. Since for a proper slicing operation of the slicer bands the tension thereof may not come below a certain minimum limit, it is necessary to set a bias which is higher than is desirable to insure that the tension does not drop below the minmum limit as the blades warm up during the slicing operation. As a consequence the operational life of the slicer bands is adversely affected.

It is an object of the present invention to provide a slicing device of the kind mentioned in the preamble, wherein the disadvantage is removed in an effective way and wherein an optimal slicing operation of the slicer bands is achieved under all circumstances.

For this purpose the slicing device according to the invention is characterized in that the tensioning means are automatically adjustable under control of a control device, in such a way that a substantially constant tension of the slicer bands is maintained.

In this way the tension can be chosen considerably lower than the preset bias mentioned before, which produces a positive effect on the operational life of the slicer bands. A good slicing operation takes place as a result of the constant tension in the slicer bands.

In a preferred embodiment of the slicing device according to the invention at least one of the drums is automatically adjustable and acts as tensioning means.

As a result the drums serve not only for driving the slicer bands, but also for maintaining a constant tension therein.

Preferably the adjustable drum is supported by means of at least one adjustable cylinder-plunger assembly, while in a very important embodiment of the slicing device according to the invention a cylinder-plunger assembly is mounted on either side of the adjustable drum, the cylinder-plunger assemblies acting as adjustable supports for the adjustable drum and being operable independently of each other.

By this latter measurement, it is possible not only to maintain a constant total load on the drum, but also to keep the drums parallel with respect to each other. In this way the operational life of the slicer bands is further increased.

It is preferred that the support means on both sides of each drum are connected to each other by a bracket, which is mounted to a stationary frame on one side of the respective drum, both brackets extending in between both parts of the slicer bands.

As a result of this single-sided suspension of the bracket of the drums, it is on one hand possible to dismount the slicer bands from the drum and to mount them again without having to dismantle the support of the drums, while on the other hand a two-sided support of the drums can be realized.

In a favourable embodiment of the slicing device according to the invention the displacement of the adjustable drum with respect to the stationary frame can be measured or scanned, and a switch contact being provided, which can be activated by an inward displacement of the adjustable drum along a predetermined distance.

In this way a force onto the slicer bands which has been increased too much as a result of external factors can be detected. One of these external factors is the pressure which is exerted onto these slicer bands by the loafs or the like guided through the slicer bands. In case the slicer bands become more blunt at a constant conveying speed of the loafs or the like the pressure of the loafs onto the slicer bands increases. This is being compensated, by the inward displacement of the adjustable drum towards the opposite drum. A predetermined displacement causes the switch contact to be activated.

According to the invention an optical signal, a slicer band grinder and/or a slicer band lubricating device may be switched on, while according to the invention it is also proposed to change the relative supply speed of the loafs or the like.

In an embodiment of the slicing device, wherein the slicer bands lie with their flat sides against the drums, and are twisted substantially 90° in respect thereof in a central area between the drums by means of guides which consist of cylindrical pins, the longitudinal axis thereof extending substantially perpendicular to the axes of rotation of the drums, it is advantageously when the pins consist of a steel, of which the smooth outer surface is treated by nitriding.

As a result of this nitriding treatment the material becomes hard and ductile, while it also obtains lubricating qualities. As a consequence the slicer bands rubbing against the guide pins only wear slightly, while the slicer bands are also prevented from becoming black by their friction and from colouring the slices of loafs black.

For a further optimization of the slicing operation of the slicer bands a slicing device having a feeding table for the bread or the like on which the loafs are guided through the slicer bands is according to the invention characterized in that the inclination of the upper face of the feeding table is adjustable with respect to the slicer bands as seen transverse to the conveying direction of the loafs.

This adjustment offers the considerable advantage, that the slicing operation can be adapted to the type and especially to the size of the loafs to be sliced. That is, it appeared, that said angle mentioned substantially affects the friction forces which are exerted by this slicer bands on the loaf during slicing. These friction forces determine not only the calm position of the bread in the slicer bands (determining the uniformity of the slice thickness), but also the magnitude of the forwardly directed resultant of these friction forces (determining the required conveying pressure on the loafs). By adjusting the angle of the upper surface of the loaf feeding table the most favourable slicing operation of the slicer bands can be obtained for every type of loaf.

The invention will hereafter be elucidated with reference to the drawing, which shows several embodiments of the slicing device for bread or the like.

Figure 1:
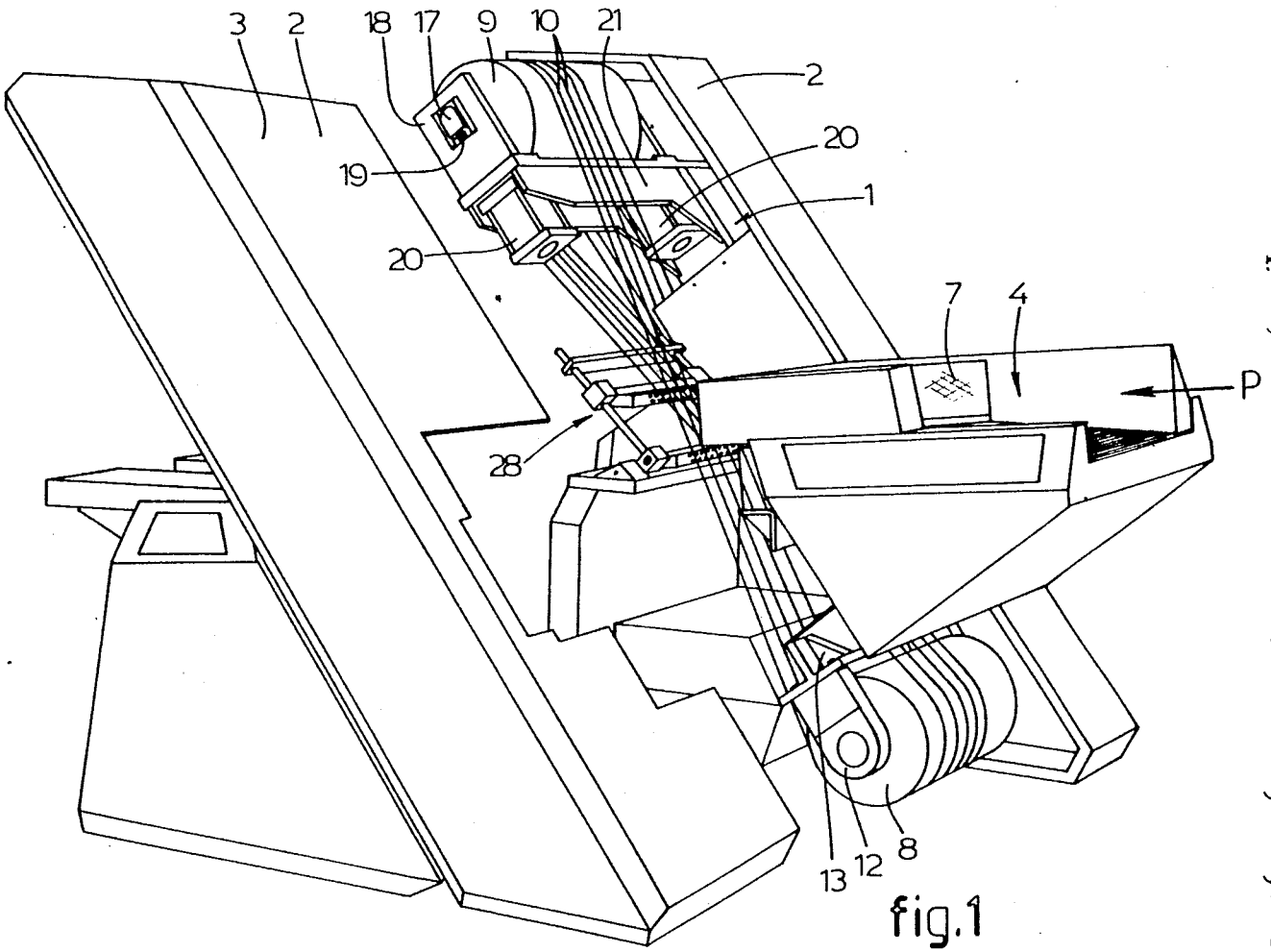
FIG. 1 is a perspective view of an embodiment of the slicing device according to the invention.

The drawing shows an embodiment of a slicing device, which is used for slicing bread. This slicing device comprises a stationary frame generally indicated with reference numeral 1. In the operative position of the slicing device the stationary frame 1 is enclosed by a cover 2 (FIG. 1), such that the movable parts of the device are entirely guarded. For the sake of maintenance and repair operations the cap 2 is constructed so as to be divisible vertically into two parts, a part 3 of the cover 2 may be loosened and may be driven away by means of a carriage provided with wheels (not shown). In this way all parts of the slicing device can be easily reached.

The slicing device has a feeding table 4, onto which the loafs are conveyed in the direction of the arrow P into the slicing device by means of a feed arrangement. In the illustrated embodiment the feed arrangement comprises two endless conveyor belts 7, one at either side of the feeding table 4 and each thereof being passed over upright rolls 6, the endless conveyor belts 7 being adapted to engage the ends of the loafs. The driving of the feed arrangement can for instance be effected by means of an electric motor 32, which drives the axis of one of the rolls 6 of each conveyor belt 7 through a gear mechanism 33 (see FIG. 4).

The slicing device comprises a plurality of endless slicer bands 10 which are passed over a lower drum 8 and an upper drum 9 and which extend substantially parallel to each other. For the sake of simplicity the drawing illustrates only a few of such slicer bands 10, while it has to be understood that in fact a greater amount of slicer bands 10 are passed side by side over the drums 8 and 9. The slicer bands 10 are provided with saw teeth at one of their sharp edges for slicing the loafs.

The lower drum 8 is mounted on an axle 11, which is rotatably supported by bearings 12 at either side of the drum 8. The bearings 12 are connected to each other by a bracket 13, which is rigidly connected to the stationary frame 1 on one end. On that end of the axle 9 lower drum 8 which is on the side of the fastening point of the bracket 13 a pulley 14 is provided, over which V-belts 15 pass, which can be driven by an electric motor 16.

The upper drum 9 is rotatably mounted on an axle 17, which is non-rotatably mounted in guiding blocks 18, yet may be slid up and down in the direction of the connecting line between the axes of rotation of both drums 8 and 9. Both ends of the axle 17 are movably supported by the upper end of a rod 19 forming part of the plunger of a cylinder-plunger assembly 20, which is connected to the respective guiding block 18. By adjusting the cylinder-plunger assemblies 20 the ends of the axle 17 move in their respective guiding blocks 18. Both cylinder-plunger assemblies 20, which may be of a hydraulic or pneumatic construction, are operated independently of each other, so that the distance between the lower drum 8 and the upper drum 9 as well as the parallelism of drums 8 and 9 can be controlled.

This can for instance be realized by means of a control circuit, which controls the magnitude of the displacement of the plunger of the cylinder-plunger assemblies 20 as a function of the load on the upper drum 9 and a balancing circuit which causes the displacements to be equal at both cylinder-plunger assemblies independent of the load, so that the parallelism of the drums 8 and 9 is maintained.

As a consequence of these measurements it is obtained that in case a thermal change of length of the slicer bands 10 appears for instance when the device is started, the tension or bias remains constant, as a change of length of the slicer bands 10 is automatically compensated by a displacement of the upper drum 9, which has a positive effect to the operational life of the slicer bands 10.

Additionally, the upper drum 9 can be held in a parallel position by an independent control of the cylinder-plunger assemblies in case of an asymmetrical load of the slicer bands onto the upper drum 9.

The height of the upper drum 9 will also change when the force exerted by the loafs onto the slicer bands 10 varies. This force will increase for instance when at a constant conveying speed of the loafs the slicing capacity of the slicer bands 10 decreases as a result of a blunting of the saw teeth. In case the displacement of the upper drum 9 is measured or scanned a switch, which is not shown, can be activated when the upper drum 9 is displaced along a predetermined distance in the direction of the lower drum 8. By activating the switch it is for instance possible to give an optical signal in order to warn that the slicer bands 10 have become too blunt. However, it is also possible that the switch causes an integrated slicer band grinder, or a slicer band lubricating device respectively to be switched on and/or the conveying speed of the loafs to be slowed down. Such signalling or controlling respectively not only improves the control convenience of the slicing device, but can also prevent a rupture of the slicer bands at inconvenient moments.

Both guiding blocks 18 are connected to each other by a bracket 21, which is connected to the stationary frame 1 on the same side as the bracket 13 is. The brackets 13 and 21 have such a configuration and extend in such a way in between both parts 10' and 10'' of the slicer bands 10, that it is possible to remove the slicer bands 10 of the drum 8 and 9 and to install them again without having the drums 8 and 9 dismantled.

Each slicer band 10 is passed over the drums 8 and 9 in such a way, that a leading part 10' and a return part 10'' cross each other between the drums 8 and 9. On the drums 8 and the slicer bands 10 lie with a flat side against the surface of the drums 8 and 9, and between the drums 8 and 9 the slicer bands 10 are twisted 180°. In the central region between the drums 8 and 9 the slicer bands 10 are twisted 90° with respect to their position on the drums 8 and 9, in such manner that the saw teeth of the parts 10' and 10'' are directed in the same direction. In order to keep the slicer bands 10 exactly in their actual slicing path, the slicing device is provided with guide pins 22, which are mounted in two groups below and above the crossing point of the slicer band part 10' and 10'' in holders 23, which are located behind the slicer bands 10 as seen in the conveying direction of the loafs.

The guide pins 22 extend parallel to the conveying direction of the loafs and are positioned in such a way that each pair of slicer band parts 10' and 10'' engages one of the guide pins 12 at two opposite points of the outer circumference thereof. The guide pins 22 of each group are positioned in staggered relation to each other such that the longitudinal axes of the guide pins 22 located at both sides of one of the slicer bands 10 are spaced from each other in the longitudinal direction of the slicer bands 10.

In the direction of the row of slicer bands 10, the guide pins 22 are spaced from each other over such a distance that the slicer bands 10, which are twisted, can just pass between two adjacent guide pins 22. In this way the slice thickness of the loafs is determined by the outer diameter of the guide pins 22.

Figure 2:
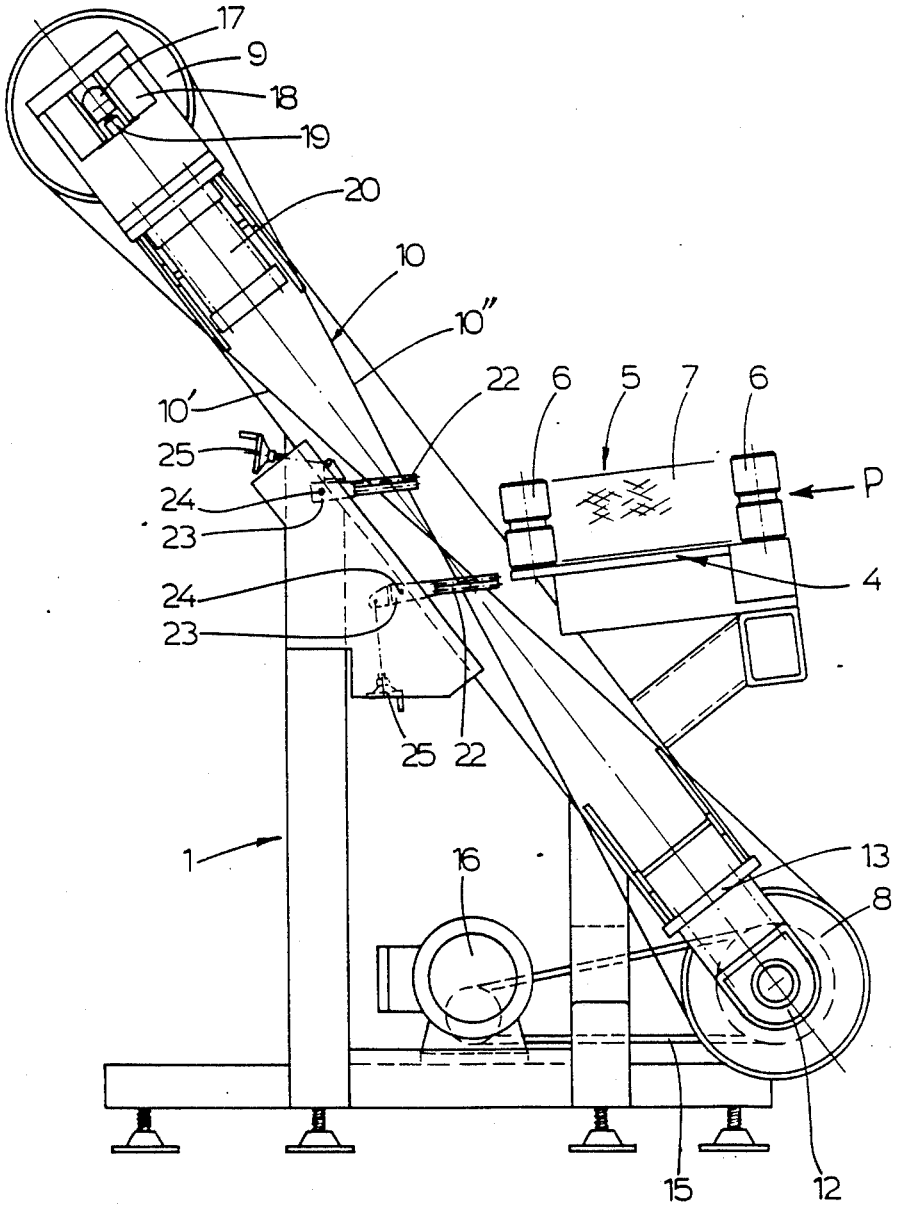
FIG. 2 is an enlarged side view of the slicing device of FIG. 1 wherein a cover is omitted for the sake of clarity.

According to FIG. 2 the holders 23 provided with the guide pins 22 are pivotable about a horizontal axle 24, and an operating mechanism 25 engages the respective holder 23, in order to operate said holder 23 with its guide pins 22 to pivot about the horizontal axle 24. Consequently it is possible to remove the guide pins 22 from in between the slicer bands 10, so that the slicer bands 10 can be removed and installed without being hindered by the guide pins 22.

The guide pins 22 preferably consists of a steel, which is hardened by means of nitriding. This is a heat treatment wherein the pins remain in an ammonia bath for 30 hours at a temperature of 500° C. In this way the steel becomes hard and ductile, and it also obtains lubricating qualities.

Both congruent sharp angles between the slicer band parts 10' and 10'' determine the so-called band distance, which is defined by the distance between both slicer band parts 10' and 10'' at the upper or lower sides of the loafs when measured in the conveying direction of the loafs. This band distance must be less than 30 mm, because it has proved that in that case high or irregular formed loafs can be prevented from falling. The band distance is determined by the diameter ratio of the drums 8 and 9, the distance between the center lines of the drums 8 and 9 and the height of the point of intersection between slicer band parts 10' and 10'' with respect to the loafs.

Tests have proved that the angle of the center line of the slicer bands 10, e.g. of the connecting line between the axes of rotation of the drums 8 and 9, with respect to the upper face of the bread feeding table 4 and therefore with respect to the supplied loafs substantially influences the friction forces exerted on the loafs by the slicer bands 10 during the slicing operation. These friction forces determine not only the calmness of the loafs in the slicer bands 10 (determining the uniformity of the slice thickness), but also the magnitude of the forwardly directed resultant of these friction forces (determining the required conveying pressure on the loafs). The most favourable position of the loafs with respect to the slicer bands 10 depends on the dimensions of the loafs. The most favourable height of the point of intersection of the slicer bands 10 with respect to the feeding table 4 also depends on the dimensions of the loafs. In order to obtain the most favourable slicing operation under all circumstances, the feeding table 4 may be of an adjustable construction.

Figure 4:
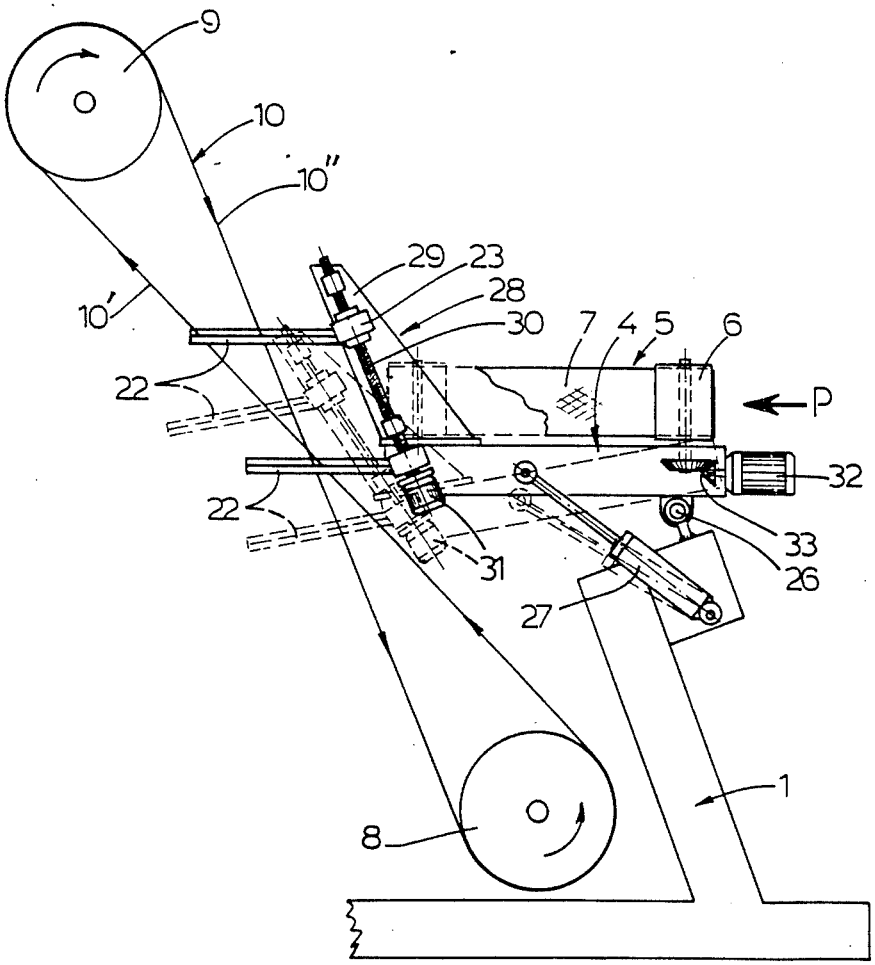
FIG. 4 is a schematic view of a modified embodiment of the slicing device according to the invention.

FIG. 4 very schematically shows an embodiment of the slicing device, wherein the adjustment of the bread feeding table 4 has been realized. For this purpose the feeding table 4 is connected pivotally about a horizontal transverse shaft 26 to the stationary frame 1 at its side facing away from the slicer bands 10. A cylinder-plunger assembly 27, which is connected on one end to the stationary frame 1 and on its other end to the bread feeding table 4, enables the feeding table 4 to rotate about the pivot shaft 26. As a result of the angular rotation of the bread feeding table 4 not only the angle between the upper face of the feeding table 4 and the slicer bands 10 changes but also the difference in level between this upper face and the point of intersection of the slicer bands 10 varies. In this way the slicing operation can be optimized for each type of bread by adjusting the feeding table 4.

By adjusting the feeding table 4 it is possible to supply the loafs to the slicer bands 10 at such an angle, that the loafs are automatically urged through the slicer bands 10 as a result of the forces between the slicer bands and the loafs. Certain angles of the feeding table lead to a resultant of forces on the bread which is directed forwardly in the plane of the bread and which has such a magnitude that the loafs pass through the slicer bands 10 without the help of external forces. This is for instance important when the last loaf of a series is being sliced, since this last loaf can not be urged through the slicer bands by a next succeeding loaf. If a detector system is provided in the path of the loafs, the last loaf can be detected and the feeding table 4 can automatically be adjusted to a position in which the last loaf is drawn through the slicer bands 10.

Figure 3:
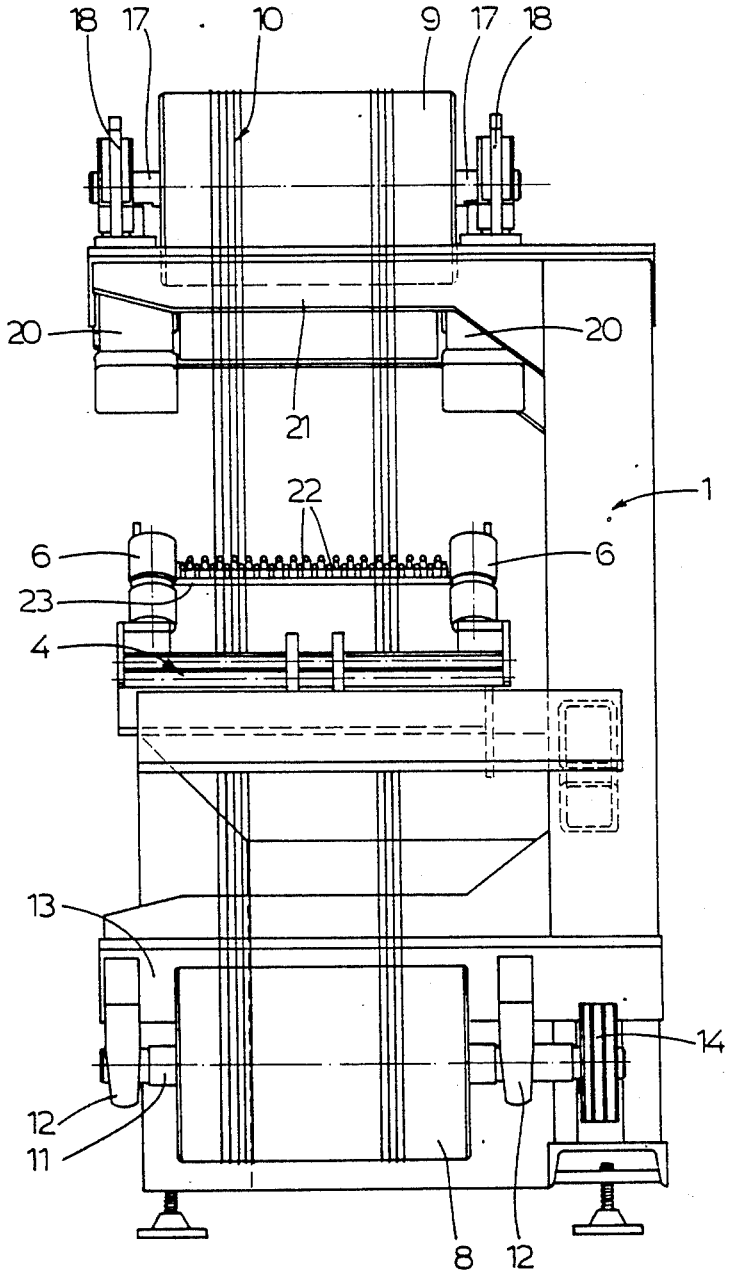
FIG. 3 is a front view of the slicing device of FIG. 2.

FIG. 4 further shows that a guide pin unit 28 is carried by the bread feeding table 4 through a supporting plate 29. This means that when the bread feeding table 4 is rotated through a certain angle the guide pins 22 move along, so that their parallelism with respect to the feeding table 4 is maintained, but their height with respect to the slicer bands 10 changes. Yet this height is adjustable independently of the adjustment of the feeding table 4 since the holders 23 of the guide pins are displaceable along rods and are connected to a screwed spindle 30 in such a way that when the screwed spindle 30 is rotated for instance by means of an electric motor 31 the holders 23 move along the screwed spindle 39. This adjustment for height of the guide pins is also realized in the embodiment of the slicing device according to the FIG. 1–3.

According to the invention there is provided a slicing device for bread or the like wherein a long operational life of the slicer bands has been assured, a reliable slicing operation has been achieved and an optimal slicing under all circumstances has been realized.

The invention is not restricted to the embodiments shown in the drawing, but can be varied in different ways within the scope of the invention.

I claim:

1. A machine for slicing bread of the like, comprising (1) a stationary frame;

(2) first and second drums rotatably mounted on the stationary frame in spaced apart opposed relation;

(3) a plurality of endless slicer bands trained over the first and second drums, the plurality of slicer bands extending substantially parallel to each other;

(4) tensioning means for tensioning the slicer bands by displacement of one of the drums toward or away from the other drum, the tensioning means including cylinder-plunger mechanisms disposed at opposite ends of the displaceable drum;

(5) the stationary frame being disposed adjacent one end of the drums and having support arms extending laterally from the stationary frame between the loops of the slicer bands to the opposite end of the drums, the cylinder-plunger mechanisms supporting the displaceable drum being carried by one of the laterally extending arms and the other drum being mounted on supports secured to the other of the laterally extending arms whereby the drums are accessible from the open side opposite the stationary frame and thereby facilitate mounting and dismounting of the slicer bands on and from the drums.

2. The slicing machine according to claim 1, wherein the slicer bands have their flat sides against the drums and the machine further includes (6) guide means situated between the drums for twisting the bands through substantially 90° whereby the cutting edges of the bands are disposed toward the items to be cut, the guide means having a plurality of spaced apart cylindrical pins between which the bands are disposed.

3. The slicing machine according to claim 1, further comprising (6) switch means adapted to be actuated upon the displacement of the displaceable drum toward the opposed drum by a predetermined distance.

4. The slicing machine according to claim 3, further comprising (7) optical means responsive to actuation of the switch means for providing an indication of the dulling of the cutting edges of the bands.

5. The slicing machine according to claim 3, further comprising (7) lubricating means responsive to actuation of the switch means for lubricating the slicer bands.

6. The slicing machine according to claim 3, further comprising (7) feed means for feeding items to be sliced toward the slicer bands, the feed means being adapted to alter the speed at which the items are fed into the slicer bands in response to actuation of the switch means.

7. The slicing machine according to claim 1, further including (6) a table for feeding the items to be sliced toward the slicer bands, the table being pivotally supported on the stationary frame, and (7) adjustable means for adjusting the inclination of the table relative to the adjacent cutting edges of the slicer bands, 8. The slicing machine according to claim 1, wherein the slicer bands have their flat sides against the drums and the machine further includes (6) band twist guide means situated between the drums for twisting the bands through substantially 90° whereby the cutting edges of the bands are disposed toward the items to be cut, the guide means having a plurality of spaced apart cylindrical pins between which the bands are disposed, (7) a table for feeding the items to be sliced toward the slicer bands, the table being pivotally supported on the stationary frame, the band twist guide means being supported by the table, and (8) adjustable means for adjusting the inclination of the table relative to the adjacent cutting edges of the slicer bands.

9. A machine for slicing bread or the like, comprising (1) a stationary frame;

(2) first and second drums rotatably mounted on the stationary frame in spaced apart opposed relation;

(3) a plurality of endless slicer bands trained over the first and second drums, the plurality of slicer bands extending substantially parallel to each other;

(4) tensioning means for tensioning the slicer bands by displacement of one of the drums relative to the other drum, the tensioning means including adjustable cylinder-plunger mechanisms disposed at opposite ends of the displaceable drum;

(5) control means for independently controlling the displacement of the plunger of each cylinder-plunger mechanism as a function of the load on the displaceable drum; and (6) balancing means for balancing the displacement of the plungers independent of the load to maintain the displaceable drum parallel to the other drum.

10. The slicing machine according to claim 9, wherein the slicer bands have their flat sides against the drums and the machine further includes (7) guide means situated between the drums for twisting the bands through substantially 90° whereby the cutting edges of the bands are disposed toward the items to be cut, the guide means having a plurality of spaced apart cylindrical pins between which the bands are disposed.

11. The slicing machine according to claim 9, further comprising (7) switch means adapted to be actuated upon the displacement of the dispaceable drum toward the opposed drum by a predetermined distance.

12. The slicing machine according to claim 11, further comprising (8) optical means responsive to actuation of the switch means for providing an indication of the dulling of the cutting edges of the bands.

13. The slicing machine according to claim 11, further comprising (8) lubricating means responsibe to actuation of the switch means for lubricating the slicer bands.

14. The slicing machine according to claim 11, further comprising (8) feed means for feeding the items to be sliced toward the slicer bands, the feed means being adapted to alter the speed at which those items are fed into the slicer bands in response to actuation of the switch means.

15. The slicing machine according to claim 9, further including (7) a table for feeding the items to be sliced toward the slicer bands, the table being pivotally supported on the stationary frame, and (8) adjustable means for adjusting the inclination of the table relative to the adjacent cutting edges of the slicer bands.

16. The slicing machine according to claim 9, wherein the slicer bands have their flat sides against the drums and the machine further includes (7) band twist guide means situated between the drums for twisting the bands through substantially 90° whereby the cutting edges of the bands are disposed toward the items to be cut, the guide means having a plurality of spaced apart cylindrical pins between which the bands are disposed, (8) a table for feeding the items to be sliced toward the slicer bands, the table being pivotally supported on the stationary frame, the band twist guide means being supported by the table, and (9) adjustable means for adjusting the inclination of the table relative to the adjacent cutting edges of the slicer bands.

* * * * *